United States Patent [19]

Wingert

[11] Patent Number: 4,946,087

[45] Date of Patent: Aug. 7, 1990

[54] STAPLE DRIVING TOOL

[75] Inventor: Rudolf Wingert, West Milford, N.J.

[73] Assignee: Arrow Fastener Company, Inc., Saddle Brook, N.J.

[21] Appl. No.: 364,088

[22] Filed: Jun. 8, 1989

Related U.S. Application Data

[62] Division of Ser. No. 203,485, Jun. 6, 1988, Pat. No. 4,858,813, which is a division of Ser. No. 76,327, Jul. 22, 1987, Pat. No. 4,770,335, which is a division of Ser. No. 794,305, Nov. 1, 1985, Pat. No. 4,700,876.

[51] Int. Cl.[5] ..... B25C 7/26; B25C 7/36

[52] U.S. Cl. ..... 227/131; 227/156

[58] Field of Search ..... 227/19, DIG. 1, 131, 227/156, 67

[56] References Cited

U.S. PATENT DOCUMENTS

| | | | |
|---|---|---|---|
| 3,347,438 | 10/1967 | Doherty | 227/131 |
| 3,589,587 | 6/1971 | Manganaro | 227/131 |
| 3,786,978 | 1/1974 | Manganaro | 227/131 X |
| 3,950,721 | 4/1976 | Manganaro | 227/131 X |
| 4,033,500 | 7/1977 | Manganaro | 227/131 |
| 4,108,345 | 8/1978 | Manganaro | 227/131 |
| 4,375,867 | 3/1983 | Novak et al. | 227/131 X |
| 4,524,897 | 6/1985 | Bachmann | 227/131 |
| 4,592,502 | 6/1986 | Judge | 227/131 |
| 4,611,742 | 9/1986 | Rieker et al. | 227/131 |

*Primary Examiner*—Paul A. Bell

*Attorney, Agent, or Firm*—Pasquale A. Razzano; Curtis, Morris & Safford

[57] ABSTRACT

A hand-held staple driving tool is provided for driving staples near to obstructions, such as walls. The tool has a solenoid, a olenoid plunger and a staple driving knife which is mounted generally parallel to the axis of the solenoid, but outboard of it near the front of the housing. The staple driving knife is connected to the solenoid plunger by means of an overhung transverse drive beam which is connected at its forward end to the upper part of the knife and at its rearward end to the top of the plunger. The tool further has a siamese twin housing which has a live hinge at its front end. The tool has an extended staple driving chute to permit driving staples into small recesses. The tool further has a combination mounting and grounding device using only a single screw. A staple driving tool is also provided which has a staple driving knife centrally aligned with the solenoid plunger and connected to it by means of arcuate wings on the upper end of the knife press fitted around an attachment rod at the bottom end of the plunger.

11 Claims, 6 Drawing Sheets

FIG. 4
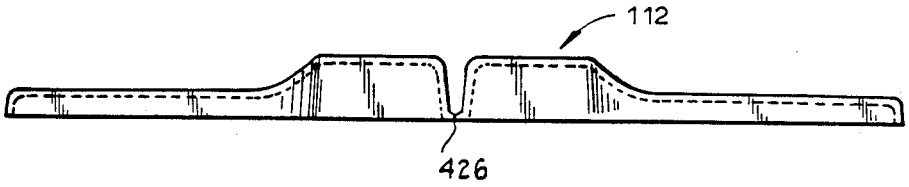
FIG. 5
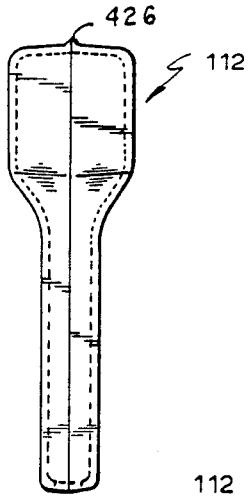
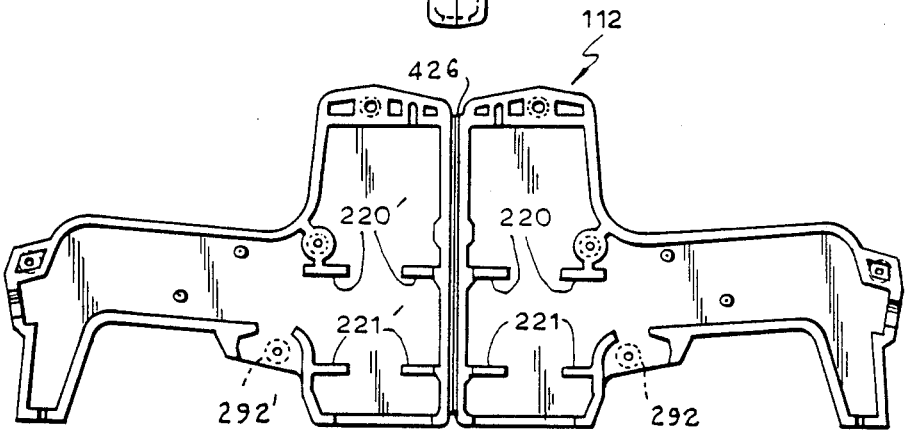
FIG. 6

STAPLE DRIVING TOOL

This application is a division of application Ser. No. 203,485, filed Jun. 6, 1988, now U.S. Pat. No. 4,858,813, which is a divisional of application Ser. No. 076,327, filed Jul. 22, 1987 now U.S. Pat. No. 4,770,335, which is a divisional of application Ser. No. 794,305, filed Nov. 1, 1985, now U.S. Pat. No. 4,700,876.

BACKGROUND OF THE INVENTION

This invention relates to staple driving tools. More particularly, it relates to staple driving tools which are hand-held and where the power for driving the staple is derived from a non-manual sorce, such as electricity.

Hand-held staple driving tools powered by electricity are well known. Typically, such staplers were powered by an electromagnetic solenoid coil which, when energized by electricity causes a moveable plunger made out of a magnetizable material such as iron or steel to be pulled into the center of the solenoid by virtue of the magnetic field created by energizing the coil. The staples typically are held on a staple rack in a magazine and delivered to the shearing region of a staple driving chute near the front of tool where they are sheared off and driven into the workpiece by means of a staple driving knife attached to the bottom of the plunger.

This knife, which shears off and drives the staples, typically extends down from the center of the bottom of the plunger through the center of the solenoid and is commonly attached to the plunger by insertion into a slot cut in the bottom center of the plunger and secured with a horizontal pin. The staple driving knife is, thus, generally aligned with and directly below the central axis of the plunger.

While this construction of a staple driving tool has proven generally satisfactory for many purposes, the placement of the staple driving knife at the bottom of the plunger so that it passes through the center of the solenoid makes it difficult or impossible to drive staples close to obstructions or into corners, because of the space taken up by the solenoid.

Staple driving tools powered by compressed air delivered to a pneumatic cylinder with a movable piston are typically similarly constructed, the piston taking the place of the magnetizable plunger as the primary drive member. Pneumatically driven staple driving tools have similar problems of only limited ability to drive staples in tight places or near to obstructions.

Previous attempts to build a staple driving tool that would have the ability to drive staples near obstructions have not been entirely successful. One construction uses a curved staple driving knife centrally extending from the bottom of the plunger, with the solenoid positioned above and to the rear. This arrangement allows the solenoid to be located rearwardly enough to avoid obstructions near the staple driving chute, from which the staples emerge, but the curved knife may jam and its position also tends to increase the vertical height of the tool, limiting the use of the tool where vertical clearance may be restricted.

Current staple driving tools commonly have housings constructed of medially split, complementary sides molded of a durable plastic, such as polypropylene. In mass production of such molded plastic housings, it is possible for different batches of housings to have slight variations in color. In order to avoid the cosmetically unacceptable appearance caused by housing sides which have noticeably varying color, it is common to attach complementary mold sides together which are molded from the same batch of plastic, after molding but before final assembly, by such temporary means as rubber bands or string. This ensures color uniformity of the assembled product, but the need to keep matched housing sides attached with rubber bands or strings prior to the final assembling process is cumbersome and interferes with efficient mass production assembly.

Countersunk holes for attachment screws are also typically molded into the sides around the periphery of the housing so that the sides can be attached together by means of the housing attachment screws. Due to the fact that the sides are separate, and a large proportion of the stress on the housing occurs at the front end of the tool where the primary driving means, such as the solenoid, is located, attachment screws must generally be placed along the front end of the housing of the stapler in order to assure sturdy construction. This need for screws at the front end of the stapler tends to further exacerbate the clearance between the staple driving knife and the front of the stapler, making it even more difficult to drive staples near obstructions.

Electrically powered staple driving tools typically have a metal, usually steel, staple magazine assembly. The magazine assembly includes a staple magazine, which holds and delivers staples to a position for driving, and a mainframe assembly, which supports and contains the staple magazine. The mainframe assembly has a frame or channel which forms the main horizontal structural member for the staple driving tool, and a front cover attached at the front end of the mainframe channel which forms a wall of the staple driving chute to guide the staples, and the staple driving knife. The mainframe channel is typically mounted to the bottom of the housing of the tool. The mainframe assembly, including both the front cover and the mainframe channel, is typically metal and is typically exposed to the user. To minimize the risk of electrical shock to the user, the mainframe channel is preferably connected to ground by means of a ground wire. Typically, connection of a ground wire to the mainframe channel is made independently of any mounting means of the housing of the tool to the mainframe channel. Although this satisfactorily insures grounding of the mainframe channel, and the other metal parts of the magazine assembly which are connected together, the use of separate fasteners for the ground wire, and for the mounting of the mainframe to the housing causes additional expense in manufacturing.

OBJECTS OF THE INVENTION

An object of the invention is to provide a powered staple driving tool which is capable of driving staples very close to obstructions.

Another object of the invention is to provide a staple driving tool with a molded housing which does not need attachment screws at the front end of the tool which might interfere with the ability of the tool to drive staples near obstructions.

It is a yet further object of the invention to provide a trigger assembly for an electrically powered staple driving tool molded of a single piece of plastic having integral pivots and cylindrical slots which fit into corresponding sockets or bushings integrally formed in the housing of the tool.

Still another object of the invention is to provide a staple driving tool having a housing which will have a uniform color on both sides without the need for temporary attachment of complementary sides prior to final assembly and which will be easier to assemble and require no screws along the front end.

It is a still further object of the invention to provide, for staple driving tools, an improved combination solenoid plunger and staple driving knife which has only two parts and is both durable and easy to assemble.

A still further object of the invention is to provide a staple driving tool where a single screw may be utilized both to mount the mainframe channel to the housing of the tool and to simultaneously connect the ground wire to the mainframe.

SUMMARY OF THE INVENTION

In accordance with an aspect of the present invention, a housing for a hand-held, power-driven staple driving tool is provided which has a plurality of sides, with at least two of the sides being connected together with a live hinge.

This live hinge is preferably flexible enough to pemit opening of the sides to facilitate normal assembly of the internal parts of the tool and to permit maintenance, yet rigid enough to supply the structural connection of the two sides of the tool. Through the placement of the live hinge with its axis along the vertical front seam of the tool, it is unnecessary to include attachments screws along the front end of the housing. The use of the live hinge further insures that the color of the two housing sides will be uniform without cumbersome temporary attachment of matched sides.

In accordance with another aspect of the present invention, a staple driving tool having a housing is provided with a primary drive member which is adapted to be moved between extended and retracted positions. Means are provided for urging this primary drive member from the retracted position to the extended position, and means are provided for dimpelling the primary drive member between extended and retracted positions in a generally linear direction against the force of the urging means. Means for actuating said impelling means are provided. A mainframe assembly is mounted to the housing and a staple magazine is mounted to the mainframe assembly in a predetermined position. In the case of an electrically-powered staple driving tool, the impelling means is conveniently a magnetic solenoid coil, and the primary drive member is conveniently a solenoid plunger which is pulled into the center of the solenoid coil when the coil is energized. A staple driving knife which has a generally straight portion is positioned outboard of the impelling means, non-axially aligned with the primary drive member and further oriented with its major dimension generally parallel to the direction of motion of the primary drive member. This staple driving knife is operatively connected to the primary drive member above the impelling means so that when the primary drive member is impelled, the movement of the primary drive member in a generally linear direction simultaneously causes an approximately equal and generally linear motion of the staple driving knife in generally the same direction as the primary drive member.

In an embodiment of this invention, this operative connection is a transverse drive beam attached at one of its ends to the upper end of the primary drive member and is disposed above the impelling means. This transverse drive beam extends horizontally towards the front of the staple driving tool and the other of its ends is there connected to a generally straight and vertical staple driving knife positioned outboard of and generally alongside the front of the impelling means. By using the transverse drive beam and positioning the driving knife outboard of and in front of the impelling means, the problems of the space taken up by the impelling means (such as a solenoid coil, pneumatic cylinder or other equivalent impelling means) are eliminated and the knife may be placed very near the front of the housing of staple driving tool. This permits the driving of staples very near to obstructions.

In a refinement of this embodiment, a guide shaft is provided which is fixedly mounted to the housing and to an upper flange of the solenoid coil. This shaft is oriented parallel to both the staple driving knife and the primary drive member, which in this case is a solenoid plunger. This guide shaft passes through a hole in the transverse drive beam so that when the drive beam is driven up and down it slides over the guide shaft thereby providing additional stability. In a further refinement of this embodiment, the guide shaft is placed in between the staple driving knife and the primary drive member, thus utilizing space which might otherwise be wasted and in this way decreasing the overall dimensions of the tool.

In a preferred embodiment, the primary drive member is a solenoid plunger which is made of a single cylindrical piece of magnetizable material, such as iron or steel, which has an upper end which is hollow. This hollow upper end has a throat portion which fits into a corresponding opening in the drive beam and further has an expanded lip above the drive beam. This expanded lip is formed by expanding material the hollow upper end to a larger diameter than the opening in the drive beam. The lip will then retain the drive beam against the force of the urging means.

In a refinement of this embodiment, the outside diameter of this upper end is also reduced in diameter from the remainder of the plunger, so that there is a shoulder below this upper end. The transverse drive beam conveniently has an opening adapted to receive this upper end, but larger than the remainder of the plunger, so that when the upper end is inserted into the opening, the overhung transverse drive beam abuts against the shoulder. The top of the upper end of the plunger is expanded into a lip which has a larger diameter than the diameter the opening in the overhung transverse drive beam, which is immediately below the expanded lip and above the plunger shoulder. The transverse drive beam is thus conveniently and securely attached to the plunger between the lip and the shoulder.

In another embodiment, the housing the molded with an integral guide housing. This helps insure that the staple driving knife travels in a well defined straight up and down path while remaining easy to manufacture and assemble. In a refinement of this embodiment, an upper flange of the solenoid coil is also used to guide the blade. In this refinement, the edge of the flange used to guide the knife is opposed to the integral housing bushing, but vertically offset from it.

In order to further enhance the ability of the invention to drive staples close to obstructions, the tool advantageously includes an elongaged staple driving chute at the front end of the mainframe assembly, a portion of which chute extends substantially below the bottom of the mainframe, thus resembling a nose.

In a preferred form of this embodiment, the mainframe channel of this tool has an upper wall and two sidewalls connected to the upper wall on opposing sides. The interior surface of each of these sidewalls has, near the part of the sidewall which is near the front end of the channel, a forwardly facing shoulder. This shoulder is in a predetermined location on the interior surface, and is used to abut against the rear of an inside cover piece.

The elongated staple driving chute is made from a vertically disposed elongated front cover attached to the front end of said mainframe channel. This front cover has a rear face which is generally perpendicular to the major dimension of the staple magazine. This rear face of the front cover forms on of the walls of the chute and extends a substantial distance below the bottom edges of both the staple magazine and the mainframe channel. The chute has an elongated inside cover, which also extends a substantial distance below the bottom edges of both the staple magazine and the mainframe channel. This inside cover has a front face and a rear abutment portion. Means, which in a preferred embodiment are guide ribs extending from the rear face of the front cover, are provided to keep the front face of the inside cover parallel to and spaced apart from the rear face of the front cover to permit the staple driving knife to be driven between them. These means are also spaced horizontally apart a sufficient distance to permit the width of the knife to be driven between them. The inside cover is then snugly and mechanically interposed between the shoulders of the channel and the spacing means, with its front face abutted against the spacing means and with its rear abutment portion abutted against the shoulders, so that its front face is generally parallel to and and spaced away from the rear face as described. There is an opening through the front face of the inside cover which is adapted to receive the front end of the staple magazine so that the front end of the magazine can be located in a predetermined position adjacent the rear face of the front cover. The upper rim of this opening is adjacent to and overhangs the front end of said magazine so that when the front end of said staple magazine is inserted through this opening, the inside cover is captured or mechanically prevented from being removed downwardly while the front end of the magazine is in place. Thus, the inside cover is held in place without the need for welding to the front cover or other parts of the magazine or mainframe assembly.

In a preferred form of this embodiment, the front cover is a rearwardly open, U-shaped member. In this preferred form, the central region, or bight, of the U-shaped member forms the front face of the inside cover and the legs of the U-shaped member extend rearwardly to abut against the shoulders of the mainframe channel. The front face is divided into two parts, an upper face above the opening in the front face, and a lower face below that opening. The rear face of the front cover extends continuously both substantially above and substantially below the front end of the magazine when it is located in position adjacent the rear face of the front cover. This rear face has two pairs of guide ribs on it, one pair for abutting against the upper face of the inside cover and one pair for abutting against the lower face, to keep both the upper and lower face spaced away from and approximatedly parallel to the rear face of the front cover. The space between the upper face and the rear face of the front cover thus is adapted to guide the staple knife above the staple magazine, before shearing off a staple, and the space between the lower face and rear face of the front cover guides the staple after it is sheared off and the knife as it drives this staple out the exit end of the chute.

In another embodiment of the invention, an improved combination solenoid plunger and staple driving knife is provided. In this embodiment, the solenoid plunger is made of magnetizable material, such as iron or steel. The plunger further has an attachment rod of a smaller diameter than the bottom end of the plunger extending downwardly from the bottom end of the plunger. The staple driving knife is connected to this rod by tightly inserting the rod into an attachment collar formed at the top of the knife. In a preferred form of this embodiment, the attachment collar includes two opposing arcuate wings. These wings are curved around an axis approximately co-linear with the axis of the rod to form an opening which is adapted to tightly receive the attachment rod. Each of the arcuate wings has an upper shoulder portion which abuts against the bottom end of the plunger so that the thrust load from the plunger will be delivered to the knife at least in part through the upper shoulder portion of the arcuate wings. In this way, a very sturdy construction is provided which requires only two pieces and is very easy to assemble.

In a further refinement of this embodiment, the plunger includes a hollow upper end which has an uppermost expanded lip. This lip is formed by expanding the material of the hollow upper end. After expanding, the lip extends to a diameter greater than the diameter of the plunger immediately below it, and acts as a retainer for a compression return spring which is used to urge the solenoid plunger from its retracted position inside the solenoid coil to its extended position.

In another embodiment, a single piece molded trigger is provided for actuating the switch to energize the solenoid coil. In a preferred embodiment, the trigger is molded of a single piece of material, preferably a plastic material, and includes two generally planar sides with extended cylindrical pivots molded into each side. The housing of the tool is, in turn, cooperatively designed with the trigger so that the vertical housing side has a corresponding socket for the pivot, and when assembled in the normal manner slidably holds the trigger in position by the sockets. The trigger further has a recess for a return spring and a switch actuating lever. Alternatively, the trigger may be molded with an arcuate slot near the corner of each side which is adapted to slidably receive a corresponding circular bushing ring molded into the corresponding interior vertical side of the housing. In another embodiment, the pivot and arcuate slot are combined, so that the interior of the bushing ring which is molded into the housing side also includes a socket. The pivot of the trigger thereby fits into the socket and the bushing ring, in turn, fits into the arcuate slot, both providing stability and a bearing surface about which the trigger can be moved.

In another embodiments of the invention, the mainframe is conveniently mounted to the housing and connected to a ground wire by means of a single screw. In one embodiment of this combined mounting and grounding device, a screw with an enlarged end, a throat and a threaded end is passed through the flat connection end of a conventional electrical lug and, in turn, pressed into a mounting plate with an interference fit on its throat so that the grounding lug is tightly held between the enlarged end of the screw and the mounting plate. To facilitate tightly holding the grounding lug, the screw may be provided with serrations or knurling on the throat immediately below the enlarged end. The threaded end of the screw is then passed through a hole in the bottom of the housing and, in turn, through a hole in the upper wall of the mainframe. A nut is then tightened onto the exposed end of the threaded screw. In this way, a satisfactory means of grounding the mainframe is provided which does not require a separate attachment means. This facilitates assembly and reduces expense.

Another embodiment of a combination grounding and mounting device is also disclosed in which an electrical wire is attached in the conventional manner to the first end of an elongated grounding strip. The other, or second, end of the strip is split into two spaced apart fingers. Each of these fingers has a downward, right angle bend and a throat portion which extends from the downward bend in the finger. Continuing towards the endmost portion of the second end, there is a convex projection at the outer edge of the end of each finger. These projections have slanted upper edges which are inclined outwardly and downwardly from the edge of the throat portion of the fingers. These fingers, along with their convex projections, are adapted to be pressed into a hole in the upper wall of the mainframe. This hole is slightly smaller than the sidewise distance between the outside edges of the throat portions of the fingers so that when fingers are pressed into the hole until the projections are substantially through the hole in the mainframe, the spring tension of the fingers urges the fingers sidewise and outwardly against the inside of the hole to form the necessary electrical connection. A screw is also provided which has an enlarged end ad a threaded end. This screw is pressed with an interference fit or otherwise secured into a mounting plate. The threaded end of the screw is then passed, in turn, through a hole in the bottom wall of the housing, then through a hole through a middle portion of the elongated grounding strip, and then through a hole in the upper wall of the mainframe. A nut is threaded onto the exposed end of the screw and tightened, thus sandwiching all parts together.

In a further embodiment, the length of the throat portion of the fingers is slightly less than the thickness of the upper wall of the mainframe so that when the projections are pressed substantially through the hole in the upper wall of the mainframe, the spring tension will urge the fingers sidewise and outwardly so that the slanted upper edge of the projections wedges against the lower edge of the hole in the upper wall.

In a yet further embodiment, the grounding strip is also attached to the mainframe independently of the screw by means of a rivet or other convenient fastening means. In this way, a very efficient and inexpensive means of mounting and grounding the mainframe is provided.

The above and other objects, features and advantages of the present invention will be apparent from the following detailed description of illustrative embodiments thereof which is to be read in conjunction with the accompanying drawings, wherein:

BRIEF DESCRIPTION OF THE DRAWINGS

FIG. 4 is a top plan view of the opened, medially split housing of the invention having a vertical live hinge at its front end;

FIG. 5 is a top plan view of the housing of FIG. 4 in the normal assembled position;

FIG. 6 is an open face elevational view of the interior of the housing of FIGS. 1, 4, and 5 with all internal parts removed;

DETAILED DESCRIPTION

Figure 1:
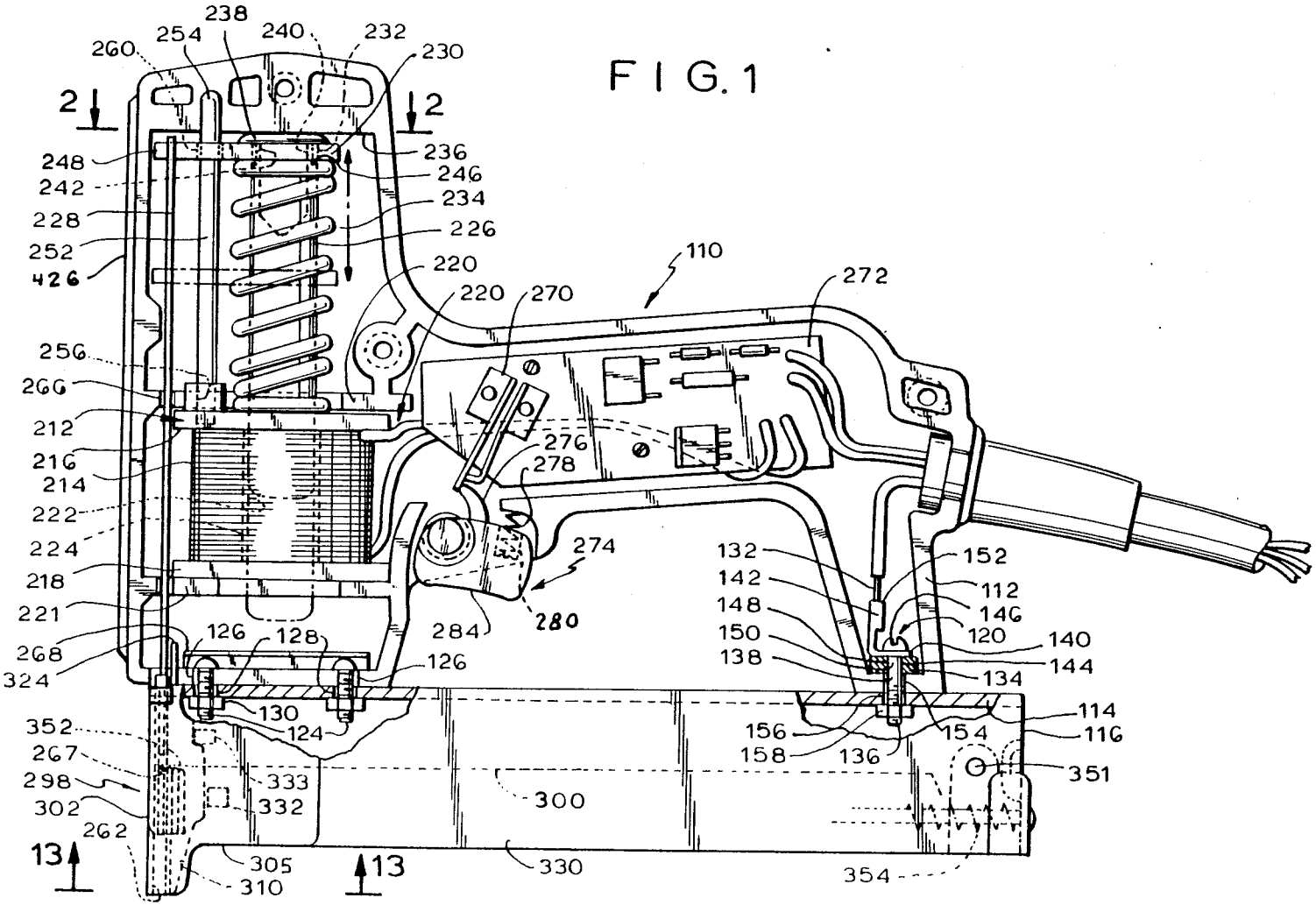
FIG. 1 is an elevation view of a portable hand-held staple driving tool having an outboard mounted staple driving knife in accordance with one embodiment of the invention, shown with one of the housing sides removed.
Figure 2:
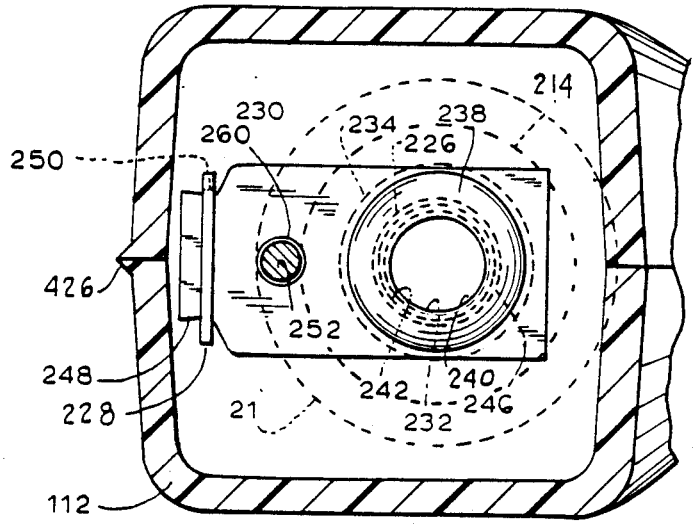
FIG. 2 is a sectional view taken along lines 2—2 of FIG. 1 illustrating the means of attachment of the transverse drive beam.

Referring now to the drawings in detail, and initially to FIGS. 1 and 2, a portable hand-held staple driving tool 110 constructed in accordance with one embodiment of the present invention is illustrated. This tool includes a medially split housing 112 preferably molded of a durable plastic such as polypropylene. In FIG. 1, only the back half of the housing is shown.

The upper wall 114 of a mainframe channel 116 is secured to housing 112 by means of a front mounting plate 118 and a rear mounting and groundng device 120 mounted within the housing. Front mounting plate 122 is a generally flat plate which should be made of a strong material such as steel. It preferably is secured to mainframe channel 116 with two screws 124, although as few as one or as many as desired could be used. The screws are preferably of steel, and extend downwardly from plate 122 and through holes 126 and 128, in the housing and mainframe channel upper wall 114, respectively, to be secured to the mainframe channel by means of nuts 130.

The rear mounting and ground device 120, shown in FIG. 1, serves the dual purpose of securing the rear of the mainframe channel to the rear of the housing and also provides a sturdy and reliable electrical connection to the grounding wire 132. To accomplish this end, a generally flat rear mounting plate 134 is provided, which should be constructed of a strong material such as steel. The threaded end 136 of a screw 138 is passed through the flat end 140 of a conventional electrical or wire lug 142 and, in turn, passes through a hole 144 in the grounding and mounting plate 134. The screw has an enlarged head 146 and a throat 148 below the head which is slightly larger than the inside of the hole 144 in the plate so that the throat of the screw must be forcibly pressed into the hole with an interference fit. When forced into the hole in this manner, the head of the screw compresses the flat end of the wire lug securely against the mounting plate, holding it firmly and forming a secure electrical connection between the wire lug and the screw even in the absence of any other fastening means. To further increase the holding power of the screw to the mounting plate, it is preferable that serrations or knurling 150 be included on the throat of the screw.

The wire holding end 152 of the wire lug is crimped or otherwise connected to the grounding wire in a conventional manner. The threaded end of the screw extends through holes 154 and 156 in the housing and upper wall 114 of the mainframe channel, respectively, and is secured by means of the nut 158 in the same manner as the front mounting plate. Although this mounting and grounding means is described as used to mount the rear of the mainframe and housing, it is apparent that the same construction could be used for the front mounting plate as well.

Figure 3A:
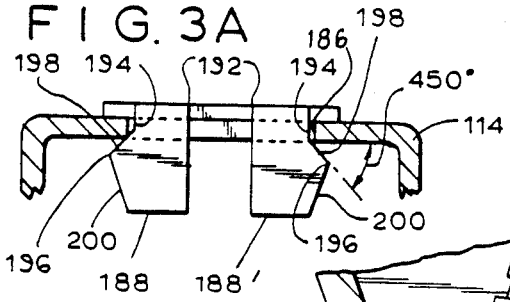
FIG. 3A is a sectional view taken along line 3A—3A of FIG. 3 illustrating the construction of the double fingered end of the grounding strip of one of the embodiments of the invention.
Figure 3:
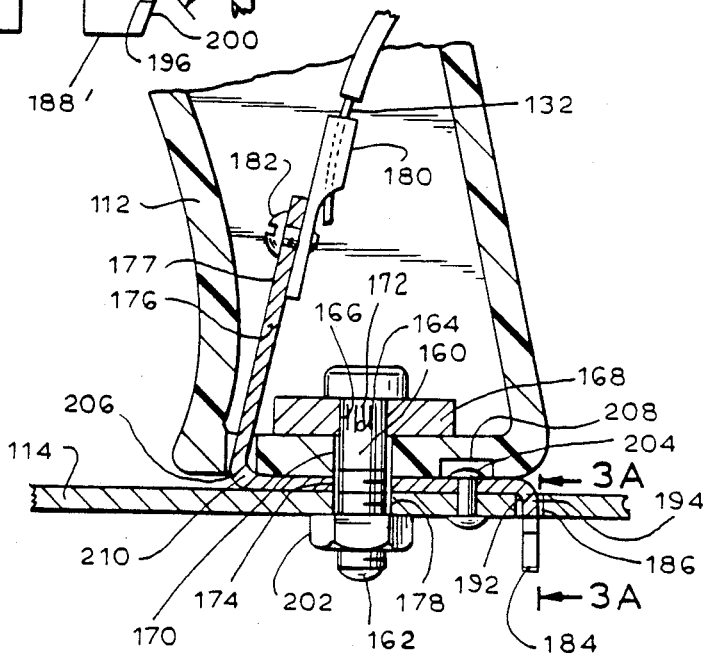
FIG. 3 is an enlarged side view illustrating an embodiment of the combination mounting and grounding device.
Figures 11, 12, 13:
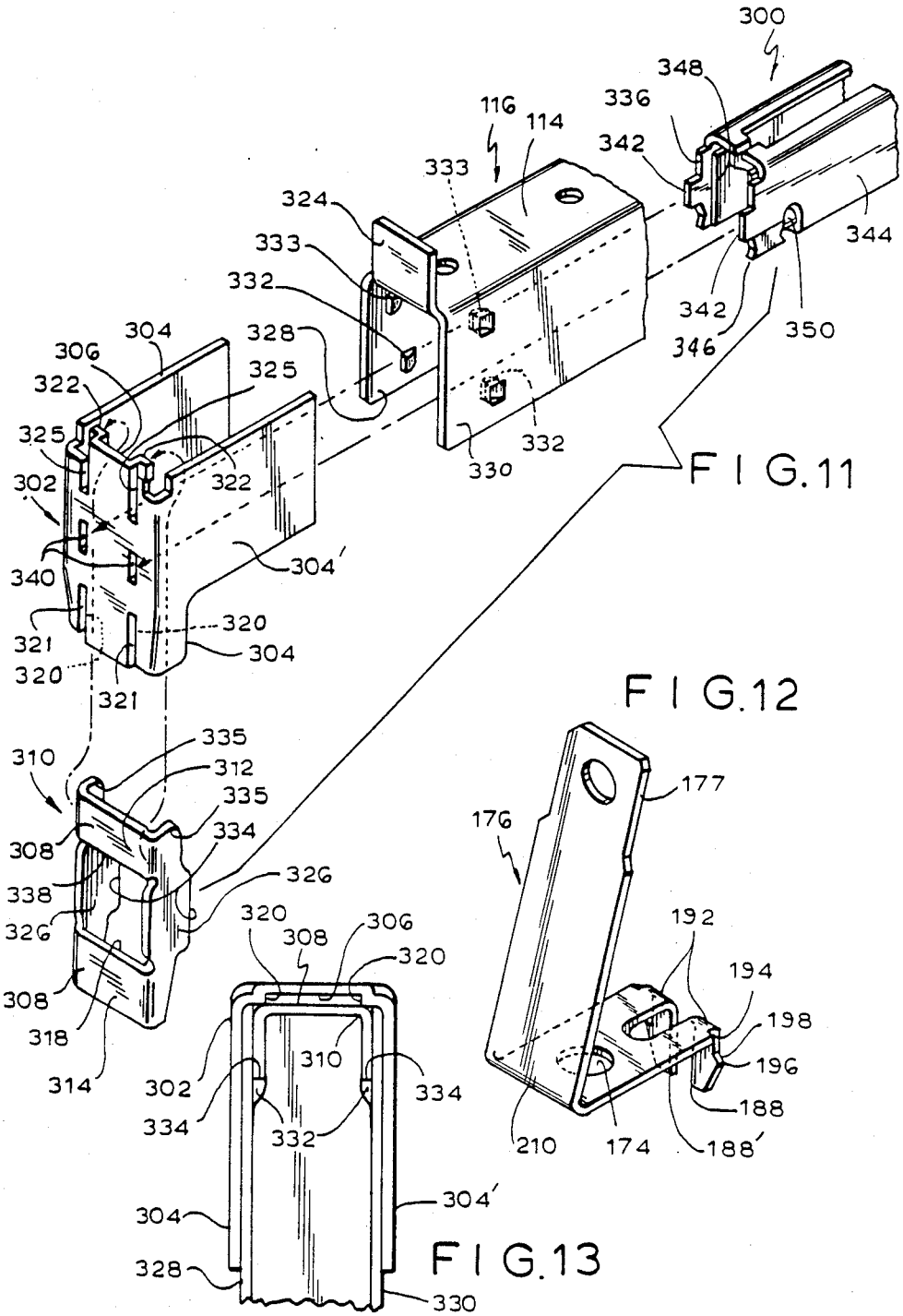
FIG. 11 is a partially exploded perspective view of an elongated staple driving chute adapted for use in the present invention, showing its assembly.
FIG. 12 is a perspective view of the grounding strip of FIG. 3A and FIG. 3, illustrating the construction of the strip.
FIG. 13 is an upward view along line 13—13 of FIG. 1 of the staple driving chute with the inside cover inserted.

An alternative embodiment of a mounting and grounding device is shown in FIGS. 3, 3A and 12. In this embodiment, the device includes a screw 160 with a threaded end 162. It is preferable that the throat portion 164 of screw 160 be slightly larger in diameter than the hole 166 in the mounting plate 168 to provide for an interference fit. The screw is inserted, and preferably forcibly pressed firmly, into the hole in mounting plate 168 and the threaded end passed through a hole 170 in the housing, adjacent the mainframe channel upper wall 114. The increase the holding power of the screw to the mounting plate, it is preferable that serrations or knurling 172 be included on the throat of the screw.

The threaded end of the screw is then passed through an opening 174 in the middle portion of an elongated grounding strip 176, which must be made of electrically conductive material, and, in turn, through a hole 178 in the upper wall 114 of the mainframe channel 116. The grounding strip has a first end 177 with means adapted to receive and secure the the grounding wire 132. As shown, this means is a conventional wire lug 180 and screw 182. The grounding strip has a second end 184 adapted to fit into a hole 186 in the upper wall of the mainframe channel.

This second end of the strip is split into two spaced apart fingers 188 and 188', which are preferably mirror images of one another. Each of these fingers has a downward, right angle bend 192 and a throat portion 194 of a predetermined length which extends from the downward bend in the finger. Continuing towards the endmost portion of the second end, there is a a convex projecton 196 at the outer edge of the end of each finger. The slanted upper edges 198 are inclined outwardly and downwardly from the edge of the throat portion of the fingers. These fingers, along with their convex projections, are conveniently pressed into a hole 114 in the upper wall of the mainframe by means of the lower slanted edge 200. The hole 186 should also be slightly smaller than the sidewise distance between the outside edges of the throat portions 194 of the fingers so that when fingers 188 and 188' are pressed into the hole until the projections are substantially through the hole 186 in the mainframe channel upper wall, the spring tension of the fingers urges the fingers sidewise and outwardly against the inside of the hole 186 to form the necessary electrical connection.

In a preferred embodiment, the length of the throat 194 is slightly less than the thickness of the upper wall 114 of the mainframe channel upper wall. The reason for this is that the upper slanted edge 198 will then be wedged tightly against the bottom edge or rim of the hole 186 in the upper wall 114. It is believed that this wedging action forms a more secure electrical connection.

It has also been found that in a preferred form of the invention, the slanted upper edge should be 25° to 65° from the horizontal, and that 45° is the most preferred angle.

When finally assembled, the threaded end of the screw 160, after passing through a hole 166 in mounting plate 168, is then passed, in turn, through the hole 170 in the bottom wall of the housing 112, then through the hole 174 through a middle portion of the elongated grounding strip, and then through the hole 178 in the upper wall 114 of the mainframe channel. The nut 202 is then threaded onto the exposed end of the screw and tightened, thus sandwiching all parts together. If the throat 194 of the second end of the strip is shorter than the thickness of the upper wall 114, this will pull the slanted upper edge 198 to dig into the bottom edge of the hole 186. In this way, a very efficient and inexpensive means of mounting and grounding the mainframe is provided.

An L-shaped bend 210 should also be placed in the grounding strip in between the wire lug 180 and the hole 174 so that the end of the grounding strip can be slipped through a separate opening 206 in the housing. In this manner, the wire connection will be neatly contained within the inside of the hollow housing.

If additional assurance of a firm electrical connection is required, the grounding strip may be mechanically secured to the mainframe by other means as well, such as the rivet 204 shown. When such an additional fastening means is used, it is preferable to provide a recess 208 in the housing so that there will be adequate clearance between the fastening means and the housing.

Referring now to FIGS. 1, 2, and 6, the construction and operation of an embodiment of the invention which permits the driving of staples very close to obstructions will be described. This embodiment has a conventional solenoid bobbin 212 and solenoid coil windings 214 wrapped around the bobbin. The bobbin has a radially extending upper flange 216 and a lower flange 218 flanking the coil windings 214. The flanges hold the windings in place and also provide a convenient means of holding the solenoid bobbin in place between the middle bulkhead 220 and the lower bulkhead 221 molded into the housing, which are also shown in FIG. 6. The solenoid bobbin, and solenoid coil, have co-axial central holes 222 and 224 respectively, which are adapted to freely receive the generally vertical solenoid plunger 226, which is made of a magnetizable material, such as iron or steel.

The plunger is operatively connected to a generally straight and vertical staple driving knife 228 by means of a transverse drive beam 230 which is preferably generally horizontal in orientation and positioned above the solenoid. The rear end of the beam is connected to the upper end of the plunger 226. The knife 228 is, thus non-axially aligned with the plunger and is outboard of the solenoid coil. The transverse drive beam should be made of a sturdy material, such as steel, and can be attached to the plunger by any convenient means.

A preferred means of connecting the beam to the plunger is by using a single piece, cylindrical plunger which has a hollow upper end 240 with a throat 242 that fits into the hole 232 in the beam. This upper end is expanded by convenient means such as mechanical forming operation so that it has an expanded uppermost lip 238. This lip is expanded to a size greater than the diameter of a hole 232 in the transverse drive beam which is adapted to receive the upper end of the plunger. The beam is then held against the expanded lip by the urging of a compression return spring 234 which surrounds the plunger and presses against the beam. The lip 238 is prevented from further upward movement by the upper housing bulkhead 236.

The lower end of the compression spring 234 is supported by the upper flange 216 of the solenoid bobbin 212. The solenoid bobbin is, in turn, supported by its lower flange 218, which abuts against the lower bulkhead 221 of the housing.

As depicted in FIG. 1, the diameter of the plunger below and adjacent to the throat portion should preferably be greater than the diameter of the throat portion 242 and of the hole 232, so that there is a shoulder 246 which abuts against the bottom surface of the beam 230. When constructed in this way, the beam must be placed on the throat 242 before expanding the lip 238. When the lip is expanded, it holds the beam firmly between the shoulder and the lip.

The forwardmost end of the transverse drive beam can be connected to the staple driving knife in any convenient manner, but it is preferably connected by means of a tongue portion 248 on the beam which passes through a notch 250 in the staple driving knife, which is depicted in FIGS. 1 and 2. The notch in the staple driving knife should be made somewhat larger than the corresponding tongue of the transverse drive beam to minimize binding between the knife in the tongue which may adversely affect the performance of the tool.

In a preferred embodiment, a guide shaft 252 is mounted in a housing recess 254 at its upper end and in a recess 256 in the upper solenoid flange 216 at its lower end. This guide shaft passes slidably through a corresponding hole 260 in the transverse drive beam to guide the transverse drive beam in an up and down path. As shown in FIGS. 1 and 2, the guide shaft is placed in between the staple driving knife and the solenoid plunger so as to make maximum use of otherwise wasted space and to minimize the overall dimensions of the tool. It should be pointed out however, that the guide shaft could also be placed 180° from its present position so that the staple driving knife and guide shaft will be disposed on opposite sides of the solenoid plunger if the rearward end of the transverse drive beam is suitably extended (not shown).

When the solenoid is energized, the magnetic field retracts the solenoid plunger against the urging of the compression spring into the center of the solenoid. This, in turn, pulls down the transverse drive beam by means of the expanded lip on the solenoid plunger, which causes an approximately simultaneous and equal parallel motion of the staple driving knife downwardly through the staple shearing and driving chute 262 which is disposed in line with the knife at the front end of the mainframe channel.

The straight up and down motion of the staple driving knife further is ensured by means of an integral bushing 266 molded into the front of the housing. As shown in FIG. 1, the solenoid upper flange, which is adjacent to the knife, acts as the opposing bushing to the integral bushing 266. It is preferred to use the outer edge of the upper solenoid bobbin flange 216 as the opposing bushing because assembly is thereby simplified, although another integrally molded housing bushing could also be used to oppose bushing 266. The upper flange is vertically offset in a downward direction from the bushing. This further eases assembly and helps to prevent binding of the blade between the flange and the integral bushing 266. As the downward moving knife is driven through the staple shearing and driving chute 262, the staple 267 which is in the chute is sheared off from a conventional supply of aligned staples 352 in the staple magazine 300 and driven through the chute into the workpiece.

As will be readily apparent in those skilled in the art, this construction places the knife very close to the front of the tool, allowing the conventient driving of staples very near to obstructions.

As the solenoid plunger reaches the end of its downward travel, it may strike the resilient pad or cushion 268 which is placed immediately above the front mainframe mounting plate 122. The impact shock of the moving plunger as it reaches the end of its stroke is thereby transmitted to the stapler mainframe and partially absorbed through the resilent action of the cushion. This construction helps to prevent bottoming of the compression spring 234 which might damage it or shorten the life of the tool. When the solenoid coil is deenergized, the solenoid plunger automatically returns to its extended position by the compression spring and strikes the upper bulkhead 236.

Figure 10:
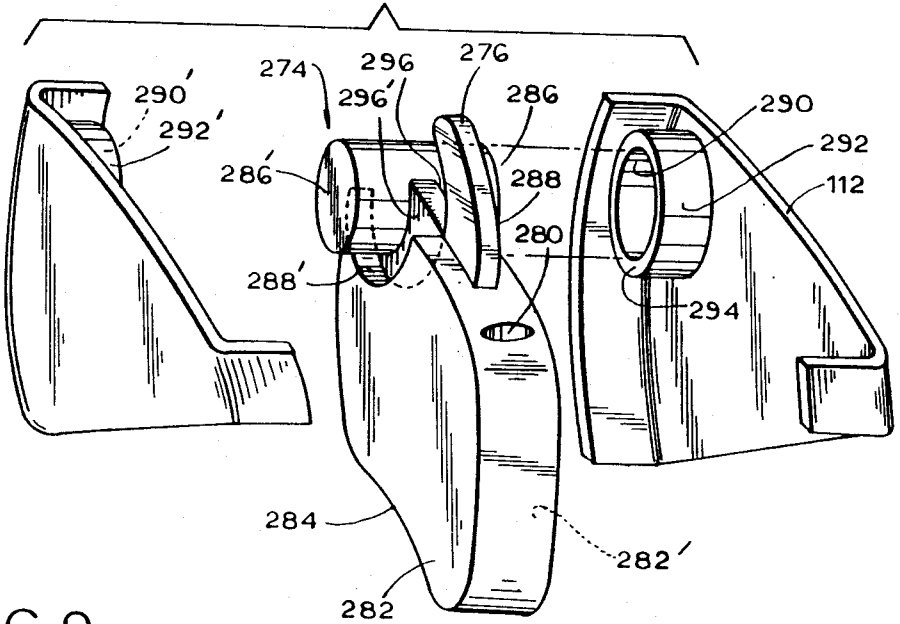
FIG. 10 is a detailed perspective view illustrating a trigger assembly in accordance with one embodiment of the present invention having a corresponding socket and bushing ring in one of the molded housing sides.

To energize the solenoid, a mechanical switch 270 and a printed circuit board 272 containing well-known electronic switching means are provided. To actuate the switch, a single piece trigger 274, preferably molded of plastic, is provided. As best shown in FIGS. 1 and 10, the trigger has a switch actuating lever 276 at its uppermost edge, a return spring 278 in a retaining recess 280 disposed behind the switch actuating lever, and parallel, planar sides 282 and 282'. The trigger further has a finger receiving surface 284 disposed on the side of the trigger furthermost from the switch actuating lever. The trigger further has mirror image cylindrical pivots 286 and 286' on either side, respectively, and cylindrical slots 288 and 288', respectively, disposed at the forward and uppermost corner of the trigger (only slot 288' can be seen in FIG. 10). Pivots 286 and 286' are adapted to be received into cyclindrical sockets 290 and 290' which are molded into the interior of the housing sides 20 and 20', which are shown in partial cut-away view in FIG. 10. These sockets also form the central hole of a bushing ring 292 which fits slidably into the corresponding arcuate slots 288 and 288'. When the sides are assembled in the normal manner with the trigger properly positioned, the pivot 286 fits slidably inside the socket 290 and , in turn, the bushing ring fits slidably into the arcuate slot 288 with the flat extended face 294 of the bushing ring abutting slidably against the corresponding flat bottom 296 of the cylindrical slot 288 so that the trigger is free to move about the common axes of the pivot and cylindrical slot. The corresponding parts on the unseen side in FIG. 10 are the same, but are mirror image.

Although it is preferred to use the cylindrical pivot and cylindrical slot together as just described, the pivot alone, or the cylindrical slot alone, may be utilized to form the axis of the trigger. In the first of these embodiments, the flat face to the bushing ring would abut the planar side of the trigger. In the second, the bushing ring would fit slidably into the cylindrical slot to provide the axial stability for the trigger.

In order to further enhance the ability of the stapler to drive staples into tight places, means may be provided at the front end of the mainframe assembly 298 defining an elongated staple driving chute 262, as shown in FIGS. 1, 11 and 13. This chute is defined by the rear face 306 of the front cover 302 and by the front face 308 of an inside cover 310, which front face has both an upper face 312 and a lower face 314 with an opening 318 between them. This staple driving chute extends a substantial distance, preferably at least 0.430 inches, below the bottom edge of the mainframe channel 116, and of the staple magazine 300 so that the tool can be slanted backwards to allow stapling into corners.

The front cover 302 advantageously has rewardly extending attachment flanges 304 and 304' which are attached to the front of the mainframe channel by spot welding or other convenient means. This front terminates in an extended nose portion 305, which is advantageously U-shaped to give rigidity to the nose portion.

The front cover 302 is formed by conventional means such as stamping, forging or casting of a single piece of sturdy material such as steel. The central portion of the interior or rear face 306 of the front cover is generally flat from top to bottom and also generally vertical, and perpendicular to the major dimension of the mainframe channel.

At the edges of the flat central portion of the rear face in the extended nose portion are two parallel, vertical and integraly formed interior guide ribs 320 spaced apart slightly wider than the width of a staple and the width of the staple driving knife. These ribs thus form the lower edges of the chute through which the staple is driven and act to guide the edges of the staple, and the edges of the staple driving knife, as they are impelled. These ribs are conveniently formed by stamping creases 321 into the front of the extended nose, which creases extend through the wall of the front cover to form the ribs 320 on the rear face. It has been found particularly advantageous to actually shear partially through the thickness of the front cover in forming these ribs. In this way the partially sheared-off interior edges of the ribs of the front cover make relatively rectangular and flat edge walls for the chute. The front cover also has similar ribs 322 at the upper end of its rear face which are also parallel, vertical and integrally formed. These ribs 322 are disposed above the front end 336 staple magazine and form the upper edges of the chute to guide the edges of the knife as it is driven downwardly to shear off a staple. These ribs 322 are also conveniently formed by creases 325 in the same way as the upper ribs 320.

Both pairs of ribs 320 and 322, by virtue of their protrusion from the rear face, act to keep the front face 308 of the inside cover 310 spaced away from and parallel to the rear face of the front cover to allow passage of the staple knife between them. It is also apparent that other spacing means besides the ribs integrally formed on the rear face of the front cover could be used, such as a separate spacer piece, or protrusions formed in the front face of the inside cover 310.

In a preferred embodiment, the mainframe channel 116 of this tool has an upper wall 114 and two side walls 328 and 328' connected to the upper wall on opposing sides. The back of the knife is also guided slidably into the chute by means of flange 324 of the upper wall 114 of the mainframe channel. The interior surface of each of these side walls 328 and 328' has, near the part of the side wall which is near the front end of the channel, forwardly facing lower shoulders 332 and upper shoulders 333. These shoulders are in predetermined locations on the interior surfaces, and are used to abut against the rear portion of the inside cover piece 310. To better hold the inside cover in position , two shoulders 332, one above the other, are provided on each side wall.

In the preferred form of this embodiment shown in FIGS. 1, 11 and 13 the inside cover 310 is a rearwardly open, U-shaped member. The inside cover is preferably formed of a sturdy material, such as steel. In this preferred form, the central region, or bight, of the U-shaped member forms the front face 308 of the inside cover and the legs 326 of U-shaped member extend rearwardly so that their ends 334 form the rear abutment portion of the inside cover and abut against the shoulders 332 of the mainframe channel. It has been found advantageous to recess slightly the upper portion 335 of the ends, and to correspondingly move forward the upper shoulders 333, to make the inside cover easier to insert. The front face 308 is divided into two parts, an upper face 312 above an opening 318 in the front face, and a lower face 314 below that opening. It has been found advantageous if the lower face is set back a slight distance, approximately 0.005 inch, to help prevent jamming of the staple driving knife as it passes the lower face. The upper pair of guide ribs 322 abut against the upper face 312 of the inside cover and the lower pair abut against the lower face 314. The space between the upper face and the rear face of the front cover thus guides the staple knife above the staple magazine, before shearing off a staple, and the space between the lower face and the rear face of the front cover guides the staple and staple knife as the knife drives the staple out the exit end of the chute.

The inside cover is snugly and mechanically interposed between the shoulders 332 and 333 of the channel and the ribs 320 and 322, with its front face abutted against the ribs and its legs abutted against the shoulders, so that both the upper face and the lower face of its front face are generally parallel to and spaced away from the rear face 306 of the front cover.

The opening 318 through the front face of the inside cover is of a size to receive, preferably fitably, the front end 336 of the staple magazine so that the front end of the staple magazine can be located in a predetermined position adjacent to the rear face of the front cover. To properly locate and retain the front end of the magazine in this predetermined position, lugs 342 are provided at the front end of the magazine which are adapted to engagably fit into corresponding holes 340 in the rear face of the front cover, which holes may extend through to the front of the front cover, as shown in FIG. 11. The rear of the magazine is conveniently mounted to the mainframe channel by means of a bolt 351, as shown in FIG. 1, in the conventional manner, thus holding the magazine to the mainframe assembly in a predetermined position. The upper rim 338 of the opening 318 is adjacent to and overhangs the front end 336 of the magazine so that when the front end of the magazine is inserted through this opening, and the lugs 342 inserted into holes 340, the inside cover is captured or mechanically prevented from being removed downwardly while the front end of the magazine is in place. Thus, the inside cover is held in place without the need for welding to the front cover or other parts of the magazine or mainframe assembly.

The staple magazine 300 is of a well known, conventional design having an outer U-shaped frame 344 with the lugs 342 at the front end thereof. Fastened to this frame by any convenient means is a U-shaped staple rack 346 with two upwardly pointing legs or flanges 348 and a bottom wall (not visible) 350 mounted to the frame 344. The front end of the frame 344, with lugs thereon, should be squared off so that the end is generally vertical so that it can fitably abut against the rear face of the front cover when the lugs are inserted into holes 340. A staple strip 352 rests on top of the flanges 348 and is urged forwardly by a spring 354 in the conventional manner so that the front staple 267 enters the staple driving chute and is abutted against the rear face of the front cover for convenient shearing off and driving into the work piece.

In operation, the knife is impelled downwardly by the solenoid through the upper portion of the chute, guided by the upper ribs 322, the upper portion of the rear face 306 of the front cover and the flange 324 of the upper wall 114 of the mainframe channel until it strikes the staple within the staple driving chute 262. This staple is then sheared off and is driven through the staple driving chute and then into the workpiece. This extended staple driving chute thus permits the driving of staples into corners and even into shallow depressions while providing an easy to assemble unit.

Figure 7:
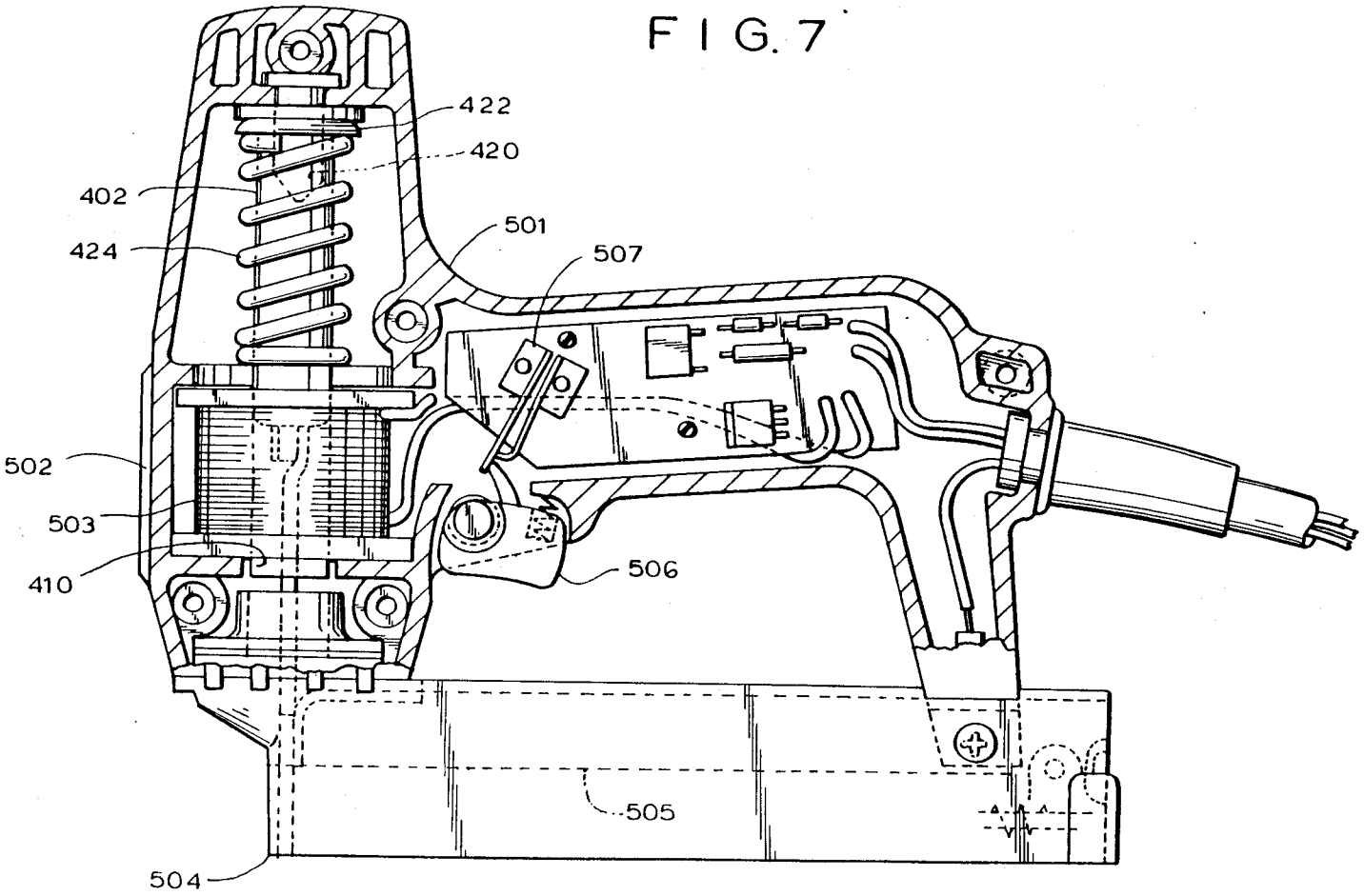
FIG. 7 is a side view, similar to FIG. 1, of another embodiment of the staple driving tool utilizing a combination solenoid plunger and staple driving knife.
Figure 8:
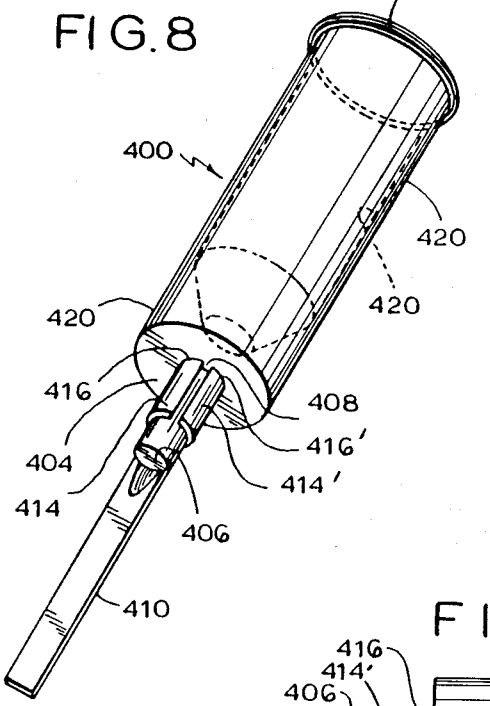
FIG. 8 is a detailed perspective view illustrating a combination solenoid plunger and staple driving knife.
Figure 9:
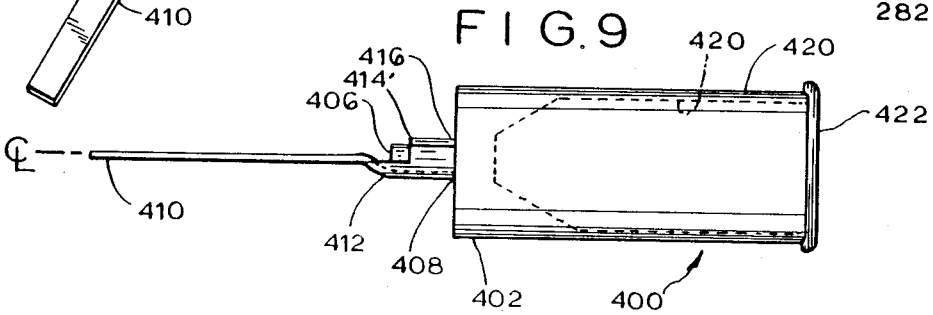
FIG. 9 is a side view of the combination solenoid plunger and staple driving knife of FIG. 8 illustrating the assembly of the knife to the plunger.

Referring now to FIG. 7, 8, and 9, and improved combination solenoid plunger and staple driving knife 400 for an electrically powered, hand-held staple driving tool is illustrated. In this embodiment, the solenoid plunger 402 is generally cylindrical and made of magnetizable material, such as iron or steel. The bottom end 404 of the plunger should preferably have a flat face which is generally perpendicular to the axis of the plunger. A generally cylindrical attachment rod 406 extends downwardly from the flat face of the bottom end of the plunger. This rod should be of a significantly smaller diameter than the body of the plunger so that a shoulder 408 is formed on the bottom end of the plunger around the circumference of the rod at its junction with the body of the plunger. A staple driving knife 410 is connected to this rod by tightly inserting the rod into an attachment collar 412 formed at the top knife. The attachment collar includes two opposing arcuate wings 414 and 414' which are curved around an axis approximately co-linear with the axis of the rod to form a generally cylindrical opening which is adapted to tightly receive the attachment rod. Each of the arcuate wings has an upper shoulder portion 416 and 416' which is parallel to and abuts against the bottom end of the plunger so that the thrust load from the plunger will be delivered to the knife at least in part through the upper shoulder portion of the arcuate wings. In this way, a very strudy construction is provided which requires only two pieces and is very easy to assemble.

In one embodiment, plunger 402 includes a hollow upper end 420 which has an uppermost expanded lip 422. This lip is formed by expanding the material of the hollow upper end. After expanding, the lip extends to a diameter greater than the diameter of the compression return spring 424 and of the body of the plunger, and thus acts as a retainer for the compression return spring. As shown in FIG. 7, the improved plunger/blade combination is used in a conventional stapler which does not use an overhung transverse drive beam. This stapler has a housing 501 which can conveniently have a live hinge 502 integrally connecting the two housing sides, a solenoid coil 503 for driving the solenoid plunger, a mainframe assembly 504 mounted to the housing, a staple magazine 505 mounted to the mainframe assembly, and a trigger 506 and switch 507 for energizing the solenoid coil. The design and operation of such staplers is well known and is the same when the improved plunger/-blade is used.

referring again to FIGS. 1, 4, 5 and 6, the staple driving tool 110 includes a siamese-twin, medially split molded plastic housing 112 with a live hinge 426 disposed at the front end of the housing. The live hinge is a relatively thin area of the housing and has an axis which extends vertically along the front seam of the housing. The live hinge should be flexible enough to permit opening of the sides to facilitate normal assembly of the internal parts of the tool and to permit maintenance, yet rigid enough to supply the structural connection of the two sides of the tool along the vertical front seam. Through the use of the live hinge, it should be unnecessary to include attachments screws along the front end of the housing. This serves to decrease assembly costs and reduce the clearance between the staple driving knife and the outside of the housing to a minimum. Furthermore, use of the live hinge further insures that the color of the two housing sides will be uniform without cumbersome temporary attachment of matched sides. Although a live hinged housing is particularly beneficial in a close clearance stapler, such a housing may also be used in any stapler and, in fact, find use in any hand-held power-driven tool.

The terms and expressions which have been employed herein are used as terms of description and not of limitation, and there is no intention in the use of such terms and expressions of excluding any equivalents of the features shown and described or portions therof. Although illustrative embodiments of the invention have been described herein with reference to the accompanying drawings, it is to be understood that various changes and modifications can be effected therein without departing from the scope or sprit of the invention.

What is claimed is:

1. A hand-held, electrically-driven staple driving tool comprising:

(a) a housing;

(b) an electromagnetic solenoid coil mounted to said housing, said coil having a central hole;

(c) means for energizing said solenoid coil;

(d) a magnetizable primary drive plunger centrally aligned with the hole of said solenoid coil, said primary drive plunger being free to move in a linear direction from an extended position to a retracted position into said central hole of said solenoid coil upon energization of said solenoid coil;

(e) means for urging said primary drive plunger from said retracted position to said extended position;

(f) a mainframe assembly mounted to said housing;

(g) a staple magazine;

(h) means for mounting said staple magazine to said mainframe assembly in a predetermined position;

(i) a generally straight staple driving knife positioned outboard of said solenoid coil and oriented generally parallel to the linear direction of motion of said primary drive plunger and non-axially aligned with said primary drive plunger; and (j) a drive beam, said drive beam being positioned above and oriented transverse to the direction of motion of said primary drive plunger and having a first end and a second end, said second end being operatively connected to the upper end of said primary drive plunger and said first end being operatively connected near the upper end of said staple driving knife so that motion of said primary drive plunger in a generally linear direction between said extended position and said retracted position causes an approximately simultaneous and equal motion of said staple driving knife in a direction generally parallel to the direction of motion of said primary drive plunger; and (k) a guide shaft fixedly mounted to the housing and positioned between said primary drive plunger and said staple driving knife, said guide shaft being slidably received into a hole in said drive beam between said primary drive plunger and said staple driving knife to guide said drive beam in an up and down path.

2. The staple driving tool as defined in claim 1, wherein said housing comprises a plurality of sides, at least two of said sides being connected together by a live hinge.

3. The staple driving tool as defined in claim 1, wherein said housing has an integral guide bushing for guiding the staple driving knife in a linear direction.

4. The staple driving tool defined in claim 3, wherein said solenoid coil further comprises a radially extending flange at its upper axial end, said flange having a central hole adapted to permit said plunger to be impelled therethrough and an edge adjacent to the staple driving knife and further opposed to and vertically offset from said bushing to guide said staple driving knife in a linear direction.

5. The staple driving tool as defined in claim 1, wherein said magazine includes an elongated staple driving chute at the front end of said staple magazine, said chute extending substantially below the bottom of said staple magazine.

6. The staple driving tool as defined in claim 1, wherein said solenoid coil further comprises a radially extending flange at its upper axial end, said flange having a central hole adapted to permit said plunger to be impelled therethrough, said flange further having means thereon for fixedly receiving an end of said guide shaft.

7. A hand-held, power driven staple driving tool comprising:

(a) a housing;

(b) a primary drive member adapted to be moved between extended and retracted positions;

(c) means for urging said primary drive member from said retracted position to said extended position;

(d) impelling means mounted to said housing for impelling said primary drive member in a generally linear direction from said extended position to said retracted position against the force of said urging means;

(e) means for actuating said impelling means;

(f) a mainframe assembly mounted to said housing;

(g) a staple magazine;

(h) means for mounting said staple magazine to said mainframe assembly in a predetermined position;

(i) a staple driving knife, said knife having an upper end, a lower end and a generally straight portion positioned outboard of said impelling means, non-axially aligned with said primary drive member and oriented with its major dimension generally parallel to the direction of motion of said primary drive member; and (j) means for operatively connecting said straight portion of said knife to said primary drive member drive member above said impelling means so that when said primary drive member is impelled, the movement of said primary drive member in a generally linear direction simultaneously causes an approximately equal and generally linear motion of said staple driving knife in generally the same direction as said primary drive member, said means for operatively connecting said knife to said primary drive member comprising a drive beam positioned above and oriented transverse to the direction of motion of said primary drive member, and having a first end and a second end, said first end of said drive beam being operatively connected to said knife near the upper end of said generally straight portion, and said second end of said drive beam being operatively connected to said primary drive member; and (k) a guide shaft fixedly mounted to the housing and positioned between said primary drive plunger and said staple driving knife, said guide shaft being slidably received into a hole in said drive beam between said primary drive plunger and said staple driving knife to guide said drive beam in an up and down path.

8. The staple driving tool as defined in claim 7, wherein said housing has an integral guide bushing for guiding the staple driving knife in a linear direction.

9. The staple driving tool as defined in claim 7, wherein said generally straight portion of said knife has an upper and a lower end, and wherein said means for operatively connecting said knife to said primary drive member comprises a drive beam positioned above and oriented transverse to the direction of motion of said primary drive member, said drive beam having a first end and a second end, said first end being operatively connected to said knife near the upper end of said generally straight portion, and said second end of said drive beam being operatively connected to said primary drive member.

10. The staple driving tool as defined in claim 7, wherein said tool includes an elongated staple driving chute at the front end of said mainframe assembly, said chute extending substantially below the bottom of said staple magazine.

11. A hand-held, electrically-driven staple driving tool comprising:

(a) a housing;

(b) an electromagnetic solenoid coil mounted to said housing, said coil having a central hole;

(c) means for energizing said solenoid coil;

(d) a drive beam having an opening of a predetermined inside diameter;

(e) a magnetizable primary drive plunger centrally aligned with the hole of said solenoid coil, said primary drive plunger being free to move in a linear direction from an extended position to a retracted position into said central hole of said solenoid coil upon energization of said solenoid coil, said primary drive plunger having a hollow upper end, said upper end having a throat portion which is adapted to be recrived into said opening in said drive beam and a shoulder portion below and adjacent to said throat portion, said shoulder portion having a diameter greater than the outside diameter of said throat portion and greater than the inside diameter of the opening in said drive beam, said plunger further having an expanded lip portion above said throat portion, said lip portion being expanded to a diameter larger than said opening in said drive beam so that when said drive beam is received onto said throat portion and abutted against said shoulder and said lip expanded, said expanded lip retains said drive beam between said lip and said shoulder;

(f) means for urging said primary drive plunger from said retracted position to said extended position;

(g) a mainframe assembly mounted to said housing;

(h) a staple magazine;

(i) means for mounting said staple magazine to said mainframe assembly in a predetermined position;

(j) a generally straight staple driving knife positioned outboard of said solenoid coil and oriented generally parallel to the linear direction of motion of said primary drive plunger and non-axially aligned with said primary drive plunger; and (k) said drive beam being positioned above and oriented transverse to the direction of motion of said primary drive plunger and having a first end and a second end, said second end being operatively connected to the upper end of said primary drive plunger and said first end being operatively connected near the upper end of said staple driving knife so that motion of said primary drive plunger in a generally linear direction between said extended position and said retracted position causes an approximately simultaneous and equal motion of said staple driving knife in a direction generally parallel to the direction of motion of said primary drive plunger.

* * * * *